US009655405B2

(12) United States Patent
Hamill

(10) Patent No.: US 9,655,405 B2
(45) Date of Patent: May 23, 2017

(54) INSOLES FOR TRACKING, DATA TRANSFER SYSTEMS AND METHODS INVOLVING THE INSOLES, AND METHODS OF MANUFACTURE

(76) Inventor: Kristan Lisa Hamill, Nokomis, FL (US)

( * ) Notice: Subject to any disclaimer, the term of this patent is extended or adjusted under 35 U.S.C. 154(b) by 1081 days.

(21) Appl. No.: 12/765,526

(22) Filed: Apr. 22, 2010

(65) Prior Publication Data

US 2011/0260857 A1 Oct. 27, 2011

(51) Int. Cl.

| | |
|---|---|
| ***G08B 1/08*** | (2006.01) |
| ***A43B 17/00*** | (2006.01) |
| ***A43B 3/00*** | (2006.01) |

(52) U.S. Cl.

CPC ..... *A43B 17/00* (2013.01); *A43B 3/0005* (2013.01)

(58) Field of Classification Search

CPC ..... A63B 2220/10; A63B 24/0062; A63B 69/0028; A61B 5/6807; A61B 5/1038; A43B 3/0005; A43B 17/00; A43B 13/00; A43B 5/00; G08B 25/016

USPC .... 340/539.13, 539.1, 573.4; 36/43, 44, 136

See application file for complete search history.

(56) References Cited

U.S. PATENT DOCUMENTS

| | | | | |
|---|---|---|---|---|
| 4,745,930 | A | 5/1988 | Confer | |
| 4,814,661 | A | 3/1989 | Ratzlaff et al. | |
| 5,875,571 | A * | 3/1999 | Huang | 36/132 |
| 6,014,080 | A | 1/2000 | Layson, Jr. | |
| 6,481,120 | B1 | 11/2002 | Xia et al. | |
| 6,549,391 | B1 | 4/2003 | Bisson | |
| 6,729,025 | B2 | 5/2004 | Farrell et al. | |
| 6,788,200 | B1 | 9/2004 | Jamel et al. | |
| 7,062,225 | B2 | 6/2006 | White | |
| 7,254,910 | B2 | 8/2007 | Guzman | |
| 7,363,731 | B2 | 4/2008 | Dana, III | |
| 7,474,206 | B2 | 1/2009 | Bertagna et al. | |

(Continued)

FOREIGN PATENT DOCUMENTS

| | | |
|---|---|---|
| WO | 2007064735 | 7/2007 |
| WO | 2008151642 | 12/2008 |

OTHER PUBLICATIONS

Diamond, et al, Integration of Analytical Measurements and Wireless Communications—Current Issues and Future Strategies, J. Talanta, Nov. 17, 2007, pp. 606-612, vol. 75, Issue 3.

(Continued)

*Primary Examiner* — Hongmin Fan

(74) *Attorney, Agent, or Firm* — Sheppard Mullin Richter & Hampton LLP

(57) ABSTRACT

A multilayer insole for removable placement in an article of footwear, the multilayer insole including a bottom insole layer having a top side, a top insole layer having an underside, an intermediate layer that is (a) an insole material layer, (b) a flexible circuit layer or (c) a bonding region for joining the bottom insole layer with the top insole layer, a location data receiving means for receiving an input signal relating to a location of the insole, and a location data transmitting means for transmitting an output signal relating to the location of the insole, wherein the location data receiving means and the location data transmitting means are both integrally associated with the multilayer insole. Also provided are a unitary insole, data transfer systems and methods of using them involving the different insoles and methods of manufacturing the different insoles.

42 Claims, 8 Drawing Sheets

(56) References Cited

U.S. PATENT DOCUMENTS

| | | | | |
|---|---|---|---|---|
| 7,579,946 | B2 | 8/2009 | Case, Jr. | |
| 7,587,937 | B2 | 9/2009 | Haselhurst et al. | |
| 7,596,891 | B2 | 10/2009 | Carnes et al. | |
| RE41,122 | E | 2/2010 | Jamel et al. | |
| 7,714,709 | B1 * | 5/2010 | Daniel | 340/539.11 |
| 2003/0009308 | A1 | 1/2003 | Kirtley | |
| 2006/0103538 | A1 | 5/2006 | Daniel | |
| 2006/0152359 | A1 | 7/2006 | Jimason | |
| 2006/0207124 | A1 | 9/2006 | Dana, III | |
| 2007/0011919 | A1 | 1/2007 | Case, Jr. | |
| 2007/0033838 | A1 | 2/2007 | Luce et al. | |
| 2007/0193070 | A1 | 8/2007 | Bertagna et al. | |
| 2007/0213930 | A1 | 9/2007 | Sakamoto et al. | |
| 2007/0276270 | A1 | 11/2007 | Tran | |
| 2008/0040951 | A1 | 2/2008 | Kates | |
| 2008/0109183 | A1 | 5/2008 | Shoureshi | |
| 2008/0127527 | A1 | 6/2008 | Chen | |
| 2010/0004566 | A1 * | 1/2010 | Son et al. | 600/592 |
| 2010/0037489 | A1 | 2/2010 | Berner, Jr. et al. | |
| 2010/0063779 | A1 * | 3/2010 | Schrock et al. | 702/188 |

OTHER PUBLICATIONS

CATSI—The World's Smallest GSP, GSM, and RF Tracking Device, webpage taken from www.gizmag.com, Jun. 24, 2009.
Smallest GSP GSM Tracking Device in the World with Audio, webpage taken from www.spymodex.com, 2005.
Spark Nano GPS Tracker is Small Enough to Fit in Your Shoe, webpage taken from www.chipchick.com, Mar. 18, 2009.
GPS Tracking for Children: What You Need to Know, webpage taken from www.streetdirectory.com, Mar. 18, 2009.
International Search Report, PCT/US2011/033443, Jan. 26, 2012.

* cited by examiner

INSOLES FOR TRACKING, DATA TRANSFER SYSTEMS AND METHODS INVOLVING THE INSOLES, AND METHODS OF MANUFACTURE

BACKGROUND OF THE INVENTION

The invention relates generally to personal tracking devices, and more particularly to a personal tracking device integrally associated with a removable insole for footwear.

On average, thousands of children under the age of eighteen are reported missing each day. Most are categorized as lost, injured, abducted or runaway children. A missing child is one of the greatest fears a parent can experience; therefore, parents and loved ones can greatly benefit from knowing exactly where their child is at all times. Tracking technology for children can give peace of mind, and also save lives when children are abducted, lost or have run away.

Tracking technology can also be used with adults. Using tracking technology, a wandering patient with Alzheimer's disease can easily be tracked and found. In the event of a natural disaster, like an earthquake, tracking technology can help locate children and adults buried under rubble. Also, in the event of a natural disaster, adult victims with tracking equipment can be located faster than those without. And, when a person is missing in remote terrain, emergency services can find those persons faster when the missing person is carrying a location tracking device.

Several types of personal location tracking apparatuses are currently available on the retail market in the form of cell phones, asset tracking devices, or tracking shoes. The cell phone and asset tracking device have a disadvantage in needing to be carried or conspicuously strapped to a person. They can easily be lost, dropped, or damaged. A disadvantage of a tracking shoe is that the user is limited to the pair of shoes with the installed tracking technology. If the installed technology malfunctions or is damaged, the tracking shoe can no longer function or must be discarded. This is cost prohibitive for the consumer. Accordingly, there is a need for a hands-free device with tracking capabilities which will allow a user the freedom to choose from a variety of shoes. And the device should be inconspicuous, easily removable, replaceable, and transferable between shoes.

BRIEF SUMMARY OF THE INVENTION

The present invention provides an inconspicuous, location providing device with tracking capabilities for adults and children in the form of a removable insole. Among other things, the invention is useful for protecting the wearer from an abductor. This insole can be embedded or otherwise integrally associated with location providing technology including one or more types of communications technology capable of communicating the location of the insole while it is in use. The insole can be inserted into a variety of different shoes or boots, thus providing the wearer with a variety of choices and ease of replacement or repair.

Illustrative embodiments of the present invention relate to an insole for removable placement in footwear, and more particularly, to a removable insole having embedded or otherwise integrally associated electronic components for providing tracking information. Other illustrative embodiments relate to a method of manufacturing the removable insole. Still other illustrative embodiments relate to a data transfer system incorporating a removable insole having electronic components for providing tracking information.

According to one embodiment, the present invention presents a multilayer insole for removable placement in an article of footwear, the multilayer insole including a bottom insole layer having a top side, a top insole layer having an underside, an intermediate layer that is (a) an insole material layer, (b) a flexible circuit layer or, in the absence of an intermediate layer which is an insole material layer or a flexible circuit layer, (c) a bonding region for joining the top side of the bottom insole layer with the underside of the top insole layer, an insole location data receiver for receiving an input signal relating to a location of the insole, and an insole location data transmitter for transmitting an output signal relating to the location of the insole, wherein the insole location data receiver and the insole location data transmitter are both integrally associated with the insole.

In another embodiment, the present invention presents a multilayer insole wherein the insole includes a material containing at least one member from the group including polyurethane, polyethylene, poly(ethylene-vinyl acetate), polyvinyl chloride, polyborodimethylsiloxane, polystyrene, acrylonitrile-butadiene-styrene, styrene-butadienestyrene, ethylene-propylene rubber, neoprene, cork, latex, natural rubber, silicone, and thermoplastic elastomeric gel.

In another embodiment, the present invention presents a multilayer insole wherein at least one of the insole location data receiver and the insole location data transmitter is individually situated at least partially (a) within the top insole layer (b) within the bottom insole layer or (c) within the intermediate layer.

In another embodiment, the present invention presents a multilayer insole wherein the insole includes a processor and a power source wherein the processor and the power source are both integrally associated with the insole.

In another embodiment, the present invention presents a multilayer insole wherein at least one of the processor and the power source is individually situated at least partially (a) within the top insole layer (b) within the bottom insole layer or (c) within the intermediate layer.

In another embodiment, the present invention presents a multilayer insole wherein at least one of the insole location data receiver and the insole location data transmitter is at least partially situated within a housing chamber embedded in the bottom insole layer.

In another embodiment, the present invention presents a multilayer insole wherein at least one of the insole location data receiver and the insole location data transmitter is at least partially situated within a continuous insole material matrix in the bottom insole layer.

In another embodiment, the present invention presents a multilayer insole wherein at least one of the insole location data receiver and the insole location data transmitter is at least partially situated between the bottom insole layer and the top insole layer.

In another embodiment, the present invention presents a multilayer insole wherein at least one of the insole location data receiver and the insole location data transmitter is at least partially situated on a bottom surface of the bottom insole layer.

In another embodiment, the present invention presents a multilayer insole wherein at least one of the insole location data receiver and the insole location data transmitter is at least partially situated on a top surface of the top insole layer.

In another embodiment, the present invention presents a multilayer insole wherein the insole location data receiver includes a receiving antenna that is either integrally associated with or independent of the insole location data transmitter, and a receiver circuit for receiving the input signal.

In another embodiment, the present invention presents a multilayer insole wherein the insole location data receiver is configured to receive the input signal from either a satellite or a terrestrial transmitter.

In another embodiment, the present invention presents a multilayer insole wherein the insole location data receiver is configured to receive the input signal from a Global Positioning System transmitter that is either a satellite or a terrestrial transmitter.

In another embodiment, the present invention presents a multilayer insole wherein the insole location data receiver is configured to receive the input signal from a cellular network, a radio network or a wireless network.

In another embodiment, the present invention presents a multilayer insole wherein the cellular network is a Global System for Mobile Communications network, a Code Division Multiple Access Network or a Time Division Multiple Access network.

In another embodiment, the present invention presents a multilayer insole wherein the cellular network is an analog signal capable network, a digital data signal capable network, a multimedia data signal capable network, an International Mobile Telecommunications-2000 (IMT-2000) family standard capable network or an International Mobile Telecommunications Advanced (IMT Advanced) family standard signal capable network.

In another embodiment, the present invention presents a multilayer insole wherein the insole location data transmitter includes a transmitting antenna that is either integrally associated with or independent of the insole location data receiver, and a transmitter circuit or a transponder circuit for transmitting the output signal.

In another embodiment, the present invention presents a multilayer insole wherein the insole location data transmitter includes a Universal Serial Bus port.

In another embodiment, the present invention presents a multilayer insole wherein the insole location data transmitter is configured to transmit the output signal to a satellite or a terrestrial receiver.

In another embodiment, the present invention presents a multilayer insole wherein the insole location data transmitter is configured to transmit the output signal to a Global Positioning System satellite or a Global Positioning System terrestrial receiver.

In another embodiment, the present invention presents a multilayer insole wherein the insole location data transmitter is configured to transmit the output signal to a cellular network, a radio network, a wireless network or a radio-frequency identification tag network.

In another embodiment, the present invention presents a multilayer insole wherein the cellular network is a Global System for Mobile Communications network, a Code Division Multiple Access Network or a Time Division Multiple Access network.

In another embodiment, the present invention presents a multilayer insole wherein the cellular network is an analog signal capable network, a digital data signal capable network, a multimedia data signal capable network, an International Mobile Telecommunications-2000 (IMT-2000) family standard capable network or an International Mobile Telecommunications Advanced (IMT Advanced) family standard signal capable network.

According to another embodiment, the present invention presents a unitary insole for removable placement in an article of footwear, the unitary insole including an insole material layer, an insole location data receiver for receiving an input signal relating to a location of the insole, and an insole location data transmitter for transmitting an output signal relating to the location of the insole wherein the insole location data receiver and the insole location data transmitter are both integrally associated with the insole.

In another embodiment, the present invention presents a unitary insole wherein the insole comprises a material containing at least one member from the group including polyurethane, polyethylene, poly(ethylene-vinyl acetate), polyvinyl chloride, polyborodimethylsiloxane, polystyrene, acrylonitrile-butadiene-styrene, styrene-butadienestyrene, ethylene-propylene rubber, neoprene, cork, latex, natural rubber, silicone, and thermoplastic elastomeric gel.

In another embodiment, the present invention presents a unitary insole wherein at least one of the insole location data receiver and the insole location data transmitter is situated at least partially within the insole material layer.

In another embodiment, the present invention presents a unitary insole wherein the insole further includes a processor and a power source wherein the processor and the power source are both integrally associated with the insole.

In another embodiment, the present invention presents a unitary insole wherein at least one of the processor and the power source is situated at least partially within the insole material layer.

According to another embodiment, the present invention presents a receiving data transfer system for receiving data from an insole, including an either a unitary or a multilayer insole for transmitting an insole output signal relating to a location of the insole, and a remote receiving system capable of communicating with the insole and configured for receiving a remote receiving system input signal relating to the insole output signal.

In another embodiment, the present invention presents a receiving data transfer system for receiving data from an insole wherein the insole output signal, relating to the location of the insole, is the same as the remote receiving system input signal.

According to another embodiment, the present invention presents a method of using a receiving data transfer system for receiving data from either a unitary or a multilayer insole, the method including transmitting an insole output signal, relating to a location of the insole and receiving a remote receiving system input signal, relating to the insole output signal from the insole, at a remote receiving system.

In another embodiment, the present invention presents a method of using the receiving data transfer system for receiving data from either a unitary or a multilayer insole wherein the insole output signal, relating to the location of the insole, is the same as the remote receiving system input signal.

According to another embodiment, the present invention presents a transmitting data transfer system for transmitting data to an insole, including either a unitary or a multilayer insole for receiving an insole input signal relating to a location of the insole, and a remote transmitting system capable of communicating with the insole and configured for transmitting a remote transmitting system output signal relating to the insole input signal.

In another embodiment, the present invention presents a transmitting data transfer system for transmitting data to an insole, wherein the insole input signal, relating to the location of the multilayer insole, is the same as the remote transmitting system output signal.

According to another embodiment, the present invention presents a method of using a transmitting data transfer system for transmitting data to an insole, the method including transmitting a remote transmitting system output signal, relating to a location of either a unitary or a multilayer insole, from a remote transmitting system, and receiving an insole input signal, relating to the remote transmitting system output signal, at the insole.

In another embodiment, the present invention presents a method of using the transmitting data transfer system, wherein the insole input signal, relating to the location of the insole, is the same as the remote transmitting system output signal.

According to another embodiment, the present invention presents a method of manufacturing a unitary insole for removable placement in an article of footwear, the unitary insole including forming an insole material layer, incorporating an insole location data receiver for receiving an input signal relating to a location of the insole, and incorporating an insole location data transmitter for transmitting an output signal relating to the location of the insole, wherein the insole location data receiver and the insole location data transmitter are both incorporated so as to be integrally associated with the insole.

In another embodiment, the present invention presents a method of manufacturing a unitary insole, wherein forming the insole material layer comprises incorporating a material containing at least one member from the group including polyurethane, polyethylene, polyethylene-vinyl acetate), polyvinyl chloride, polyborodimethylsiloxane, polystyrene, acrylonitrile-butadiene-styrene, styrene-butadienestyrene, ethylene-propylene rubber, neoprene, cork, latex, natural rubber, silicone, and thermoplastic elastomeric gel.

In another embodiment, the present invention presents a method of manufacturing a unitary insole, wherein the method further includes incorporating a processor and incorporating a power source, wherein the processor and the power source are both incorporated so as to be integrally associated with the insole.

According to another embodiment, the present invention presents a method of manufacturing a multilayer insole for removable placement in an article of footwear, the method including forming a bottom insole layer having a top side, forming a top insole layer having an underside, forming an intermediate layer that is (a) an insole material layer, (b) a flexible circuit layer or, in the absence of an intermediate layer which is an insole material layer or a flexible circuit layer, (c) a bonding region for joining the top side of the bottom insole layer with the underside of the top insole layer, incorporating an insole location data receiver for receiving an input signal relating to a location of the insole, and incorporating an insole location data transmitter for transmitting an output signal relating to the location of the insole, wherein the insole location data receiver and the insole location data transmitter are both incorporated so as to be integrally associated with the insole.

In another embodiment, the present invention presents a method of manufacturing a multilayer insole, wherein forming the insole material layer comprises incorporating a material containing at least one member from the group including polyurethane, polyethylene, poly(ethylene-vinyl acetate), polyvinyl chloride, polyborodimethylsiloxane, polystyrene, acrylonitrile-butadiene-styrene, styrene-butadienestyrene, ethylene-propylene rubber, neoprene, cork, latex, natural rubber, silicone, and thermoplastic elastomeric gel.

In another embodiment, the present invention presents a method for manufacturing a multilayer insole, wherein the method further includes incorporating a processor and incorporating a power source, wherein the processor and the power source are both incorporated so as to be integrally associated with the insole.

BRIEF DESCRIPTION OF THE DRAWINGS

The present invention is described with reference to the following drawing figures, wherein like reference numbers denote substantially similar elements.

DETAILED DESCRIPTION OF THE INVENTION

The present invention provides removable insoles having embedded or otherwise integrally associated tracking technology. In the following description, numerous specific details are set forth (e.g., particular electronic components) in order to provide a thorough understanding of the invention. Those skilled in the art will recognize, however, that the invention may be practiced apart from these specific details. In other instances, details of well known insole manufacturing and electronics assembly practices and components have been omitted, so as not to unnecessarily obscure the present invention.

Figure 1:
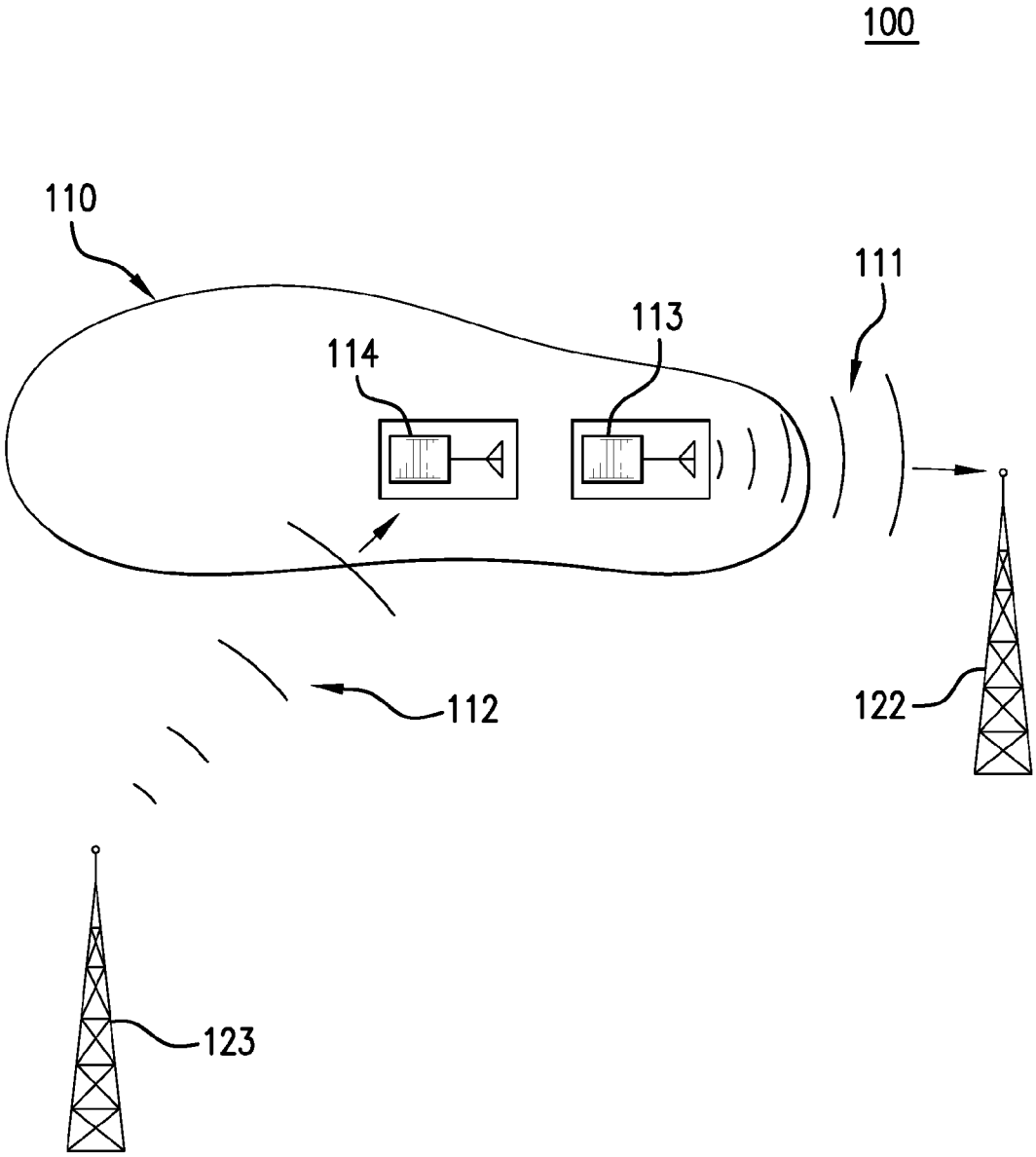
FIG. 1 is an illustrative view of a data transfer system involving a removable insole.

Referring to FIG. 1, an illustrative view showing an overall data transfer system 100. In the data transfer system 100 an insole 110 receives an input signal 112 from a remote transmitting system 123 (such as a radio system, global positioning system (GPS), a mobile telephony cellular network (e.g., GSM, CDMA, TDMA, etc.), WiFi or a wireless network, or some combination of these different systems) at the insole receiver 114. Subsequently, the insole 110 transmits an output signal 111 from the insole transmitter 113 to a remote receiving system 122 (e.g., GPS, GSM, CDMA, wireless network or an RFID tag network, etc.).

Location and Remote Transmitting Systems

The physical location of an insole 110 is first communicated to the insole through the remote transmitting system 123. The location can be derived from use of the GPS location, an E911 location, RF location, a geographical variable, and so on.

The Global Positioning System (GPS) is a U.S. space-based global navigation system based primarily on a satellite network, but that also uses some ground stations. It provides reliable positioning, navigation, and timing services to worldwide users on a continuous basis in all weather, day and night, anywhere on or near the Earth which has an unobstructed view of four or more GPS satellites.

The term "GPS location" is a location derived by use of a Global Positioning System (GPS) in any form whatsoever, including but not limited to regular GPS based on satellite position data, terrestrial GPS ground stations, and assisted GPS (A-GPS), which uses some additional cellular network information. GPS Location is based on technique of "resection" where knowing the distance from an unknown location to a certain number of known locations allows the determination of the position, e.g. coordinates, of the previously unknown location.

A cellular network is a radio network made up of a number of cells, each served by at least one fixed-location transceiver known as a cell site or base station. When joined together these cells provide radio coverage over a wide geographic area. This enables a large number of portable transceivers (mobile phones, pagers, etc) to communicate with each other and with fixed transceivers and telephones anywhere in the network, via base stations, even if some of the transceivers are moving through more than one cell during transmission.

The most common example of a cellular network is a mobile phone (cell phone) network. A mobile phone is a portable telephone which receives or makes calls through a cell site (base station), or transmitting tower. Radio waves are used to transfer signals to and from the cell phone. Large geographic areas (representing the coverage range of a service provider) are split up into smaller cells to deal with line-of-sight signal loss and the large number of active phones in an area. In cities, each cell site has a range of up to approximately ½ mile, while in rural areas the range is approximately 5 miles. In clear open areas, a user may receive signal from a cell site 25 miles away. Each cell overlaps other cell sites. All of the cell sites are connected to cellular telephone exchanges "switches", which in turn connect to the public telephone network or another switch of the cellular company.

GSM (Global System for Mobile Communications: originally from Groupe Spécial Mobile) is the most popular standard for mobile telephony cellular network systems in the world. The GSM network is divided into three major systems: the switching system, the base station system, and the operation and support system. The cell phone connects to the base system station which then connects to the operation and support station; it then connects to the switching station where the call is transferred to where it needs to go. GSM is the most common standard and is used for a majority of cell phones.

In addition to GSM, other types of networks include CDMA (Code Division Multiple Access) networks and TDMA (Time Division Multiple Access) networks. CDMA2000 is the mobile telephony standard for CDMA networks. These are different communications standards defined by the International Telecommunication Union (ITU), a United Nations agency for information and communication technology issues and the global focal point for governments and the private sector in developing networks and services.

Named families of standards for mobile telecommunications include the well-known 3G and 4G families of standards. 3G or 3rd Generation, also known as the International Mobile Telecommunications-2000 (IMT-2000) family standard, is a family of standards for mobile telecommunications fulfilling specifications set by the International Telecommunication Union, and includes UMTS, and CDMA2000 as well as the non-mobile wireless standards DECT and WiMAX. 3G (IMT-2000) allows simultaneous use of speech and data services and higher data rates (at least 200 kbit/s peak bit rate to fulfill to IMT-2000 specification). 3G systems can offer up to 14.0 Mbit/s on the downlink and 5.8 Mbit/s on the uplink.

Services include wide-area wireless voice telephone, video calls, and wireless data, all in a mobile environment. Compared to 2G and 2.5G services, 3G allows simultaneous use of speech and data services and higher data rates needed to fulfill to IMT-2000 specification.

4G refers to the fourth generation of cellular wireless standards, and is also known as IMT Advanced (International Mobile Telecommunications Advanced) family standard. As with the 3G family standard, the 4G family standard is also defined by the International Telecommunication Union. It is a successor to 3G and 2G standards. The nomenclature of the generations generally refers to a change in the fundamental nature of the service. The first was the move from analogue (1G) to digital (2G) transmission. This was followed by multi-media support, spread spectrum transmission and at least 200 kbit/s (3G) and now 4G, which refers to all IP packet switched networks, mobile ultra-broadband (gigabit speed) access and multi-carrier transmission. A 4G system provides a comprehensive and secure all-IP based solution where facilities such as IP telephony, ultra-broadband Internet access, gaming services and streamed multimedia may be provided to users. An IMT Advanced cellular system must have target peak data rates of up to approximately 100 Mbit/s for high mobility such as mobile access and up to approximately 1 Gbit/s for low mobility such as nomadic/local wireless access, according to the ITU requirements. Scalable bandwidths up to at least 40 MHz are also provided.

Communications networks can also have special location providing functions, such as the "E911" function. The term "E911 location" means a location based on using "enhanced 911", a location technology advanced by the FCC that enables mobile or cellular phones to process 911 emergency calls and enable public emergency services to locate the geographic position of the caller. The initial version of this technology involved location information associated with the nearest cell tower to a phone. The current technology required by the FCC includes either a handset- or network-based location detection capability so that a caller's location is determined by the geographic location of the phone to within one hundred meters accuracy of the latitude and longitude of the caller and not the location of the nearest tower that is transmitting its signal. The FCC refers to this as Automatic Location Identification (ALI) and it allows a wireless or mobile telephone to be located geographically using some form of radiolocation from the cellular network, or by using a Global Positioning System built into a phone or other receiver.

A wireless network refers to any type of computer network that is wireless, and is commonly associated with a telecommunications network whose interconnections between nodes is implemented without the use of wires. Wireless telecommunications networks are generally implemented with some type of remote information transmission system that uses electromagnetic waves, such as radio waves, for the carrier and this implementation usually takes place at the physical level or "layer" of the network. Wireless Personal Area Networks (WPANs) interconnect devices within a relatively small area, generally within reach of a person. For example, Bluetooth provides a WPAN for interconnecting a headset to a laptop. Wireless Wide Area Networks are wireless networks that typically cover large outdoor areas. These networks can be used to connect branch offices of business or as a public internet access system.

Remote Receiving Systems

The representative systems described above that can function as the remote transmitting system 123 can also function as a remote receiving system 122. For instance, a GSM or CDMA mobile telephony cellular network can transmit a signal 112 with location information to the insole 110. This insole 110, without any processing of the location information signal 112, other than to tag an identifier to it, can transmit the location information signal 111 back to the same GSM or CDMA network that functions as remote receiving system 123.

However, an RFID tag network may also function as a remote receiving system 123. There are generally three types of RFID tags: active RFID tags, which contain a battery and can transmit signals autonomously, passive RFID tags, which have no battery and require an external source to provoke signal transmission, and battery assisted passive (BAP) RFID tags, which require an external source to wake up but have significant higher forward link capability providing great read range.

Combination Systems for Remote Transmitting/Receiving

Combination networks that incorporate remote systems for transmitting or receiving can also be used for a remote transmitting system 123 or remote receiving system 122. Radio-location technology can provide precise positioning in difficult GPS environments by deployment terrestrially-based transceivers that transmit precise ranging signals and replicate the GPS satellite constellation—but on the ground and is complimentary to GPS. It can operate in combination with GPS or be completely independent of GPS (e.g. indoors). Using this alternative type of radio-location technology, precise radio-location can be achieved in industrial, urban and indoor environments as described in United States Published Patent Application Nos. 2009-0002238, 2008-0129591, and 2007-0040739, each of which are herein incorporated by reference in their entirety.

Insole Receivers/Transmitters

The insole receiver is an electronic circuit that receives its input from an antenna. The input may in the form of radio or other wireless transmission. The insole transmitter is also an electronic device which, with the aid of an antenna, propagates an electromagnetic signal such as radio or other telecommunications. Numerous miniature tracking devices are being developed to incorporate both a receiver and transmitter. CATSi in the U.K. provides a device that is a combination of GPS, RF and GSM technologies in the one device. The inclusion of an RF beacon allows for accurate locating when hidden inside buildings and a new GSM location technology provides almost GPS-like accuracy in mapped areas. The GSM technology relies on a GSM sim chip instead of a GSM sim card, the sim card needing a contract to access the GSM network.

Power Sources

The power source for the electronic components in the insole can be batteries that are disposable or rechargeable. A motion sensor can be used to recharge the batteries. Or the batteries or electrical components themselves can be powered from wireless power sources. Leading wireless power technology providers include: Powermat, WildCharge, WiTricity, Fulton Innovation—eCoupled, Powercast, WiPower, SplashPower and the like. The Wireless Power Consortium provides international standard for compatible wireless charging stations.

Flexible Circuits

The insole electronic components can be ordinary circuits or flexible circuits also known as flexible electronics, or some combination thereof. There are a few basic constructions of flexible circuits but there is significant variation between the different types in terms of their construction.

Single-sided flexible circuits have a single conductor layer comprised of either a metal or conductive (metal filled) polymer on a flexible dielectric film. Component termination features are accessible only from one side. Holes are formed in the base film to allow component leads to pass through for interconnection, normally by soldering. Single sided flex circuits can be fabricated with or without such protective coatings as cover layers or cover coats, however the use of a protective coating over circuits is a common practice.

Double access flex, also known as back bared flex, are flexible circuits having a single conductor layer but which is processed so as to allow access to selected features of the conductor pattern from both sides.

Sculptured flex circuits are a subset of normal flexible circuit structures. The manufacturing process involves a special flex circuit multi-step etching method which yields a flexible circuit having finished copper conductors wherein the thickness of the conductor differs at various places along their length. (i.e., the conductors are thin in flexible areas and thick at interconnection points.)

Double-sided flex circuits are flex circuits having two conductor layers. Theses flex circuits can be fabricated with or without plated through holes, though the plated through hole variation is more common.

Flex circuits having three or more layers of conductors are known as multilayer flex circuits. Commonly the layers are interconnected by means of plated through holes, though this is not a requirement of the definition for it is possible to provide openings to access lower circuit level features. The layers of the multilayer flex circuit may or may not be continuously laminated together throughout the construction with the obvious exception of the areas occupied by plated through-holes. The practice of discontinuous lamination is common in cases where maximum flexibility is required. This is accomplished by leaving unbonded the areas where flexing or bending is to occur.

Rigid-flex circuits are a hybrid construction flex circuit consisting of rigid and flexible substrates which are laminated together into a single structure. Rigid-flex circuits should not be confused with rigidized flex constructions are simply flex circuits to which a stiffener is attached to support the weight of the electronic components locally. A rigidized or stiffened flex circuit can have one or more conductor layers. Thus while the two terms may sound similar, they represent products that are quite different.

The layers of a rigid flex are also normally electrically interconnected by means of plated through holes. Over the years, rigid-flex circuits have enjoyed tremendous popularity among military product designer, however the technology has found increased use in commercial products. While often considered a specialty product for low volume applications because of the challenges, an impressive effort to use the technology was made by Compaq computer in the production of boards for a laptop computer in the 1990s. Rigid-flex boards are normally multilayer structures, however, two metal layer constructions are sometimes used.

Polymer thick film (PTF) flex circuits are true printed circuits in that the conductors are actually printed onto a polymer base film. They are typically single conductor layer structures, however two or more metal layers can be printed sequentially with insulating layers printed between printed conductor layers. While lower in conductor conductivity and thus not suitable for all applications, PTF circuits have successfully served in a wide range of low power applications at slightly higher voltages. Keyboards are a common application, however, there are a wide range of potential applications for this cost effective approach to flex circuit manufacture.

Insole Construction

The manufacture of the insole can be accomplished by molding or shaping operations such that the electronic components are integrally associated with the manufactured insoles. The components can be situated in housing chambers formed in the insole layers to hold the electronics within the insole material, or in an alternative process of manufacturing, the insole materials can be poured around the electronic components such that they are situated in a matrix of insole material.

Figure 2:
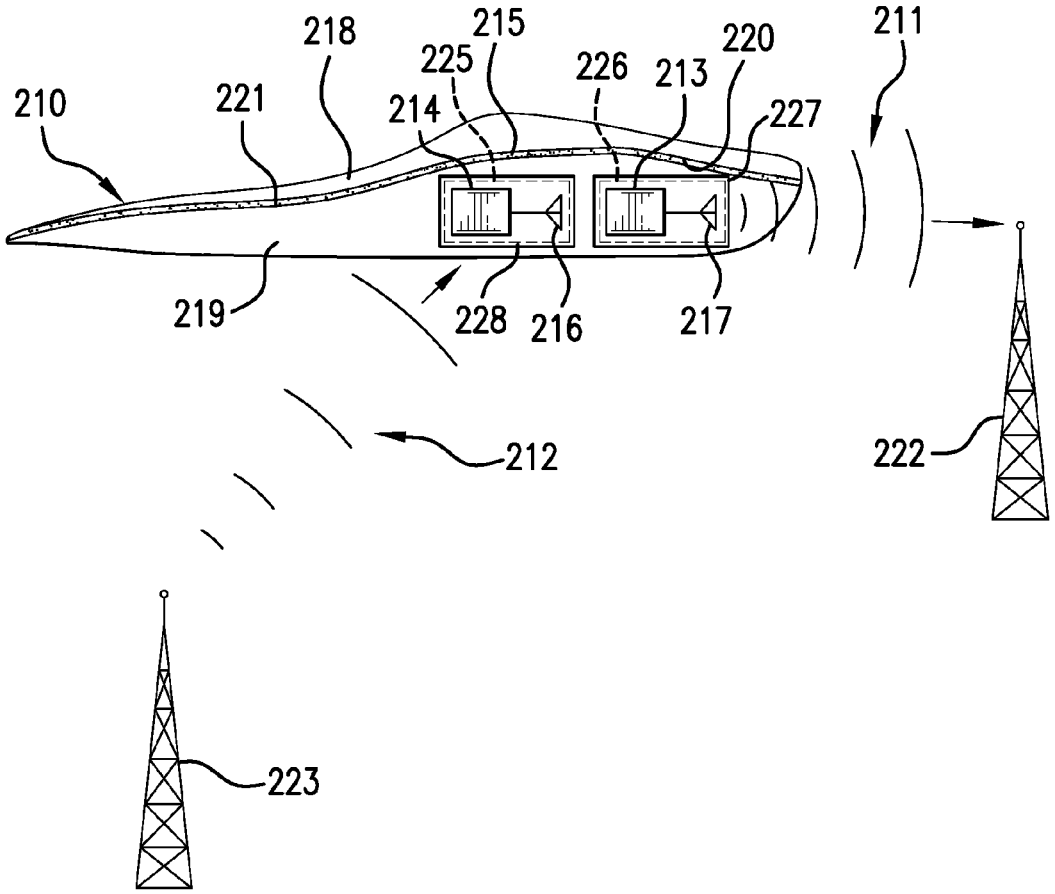
FIG. 2 is a partially cut-away side view of a multilayer removable insole in use in a data transfer system.

Referring to FIG. 2, an insole 210, according to a multilayer insole embodiment of the invention has bottom insole layer 219 having a top side 221, a top insole layer 218 having an underside 220, an intermediate region 215 showing bonding between top insole layer 218 and bottom insole layer 219, a location data receiving component 225 with a receiving antenna 216 and a receiver 214 placed within a first housing chamber 228 embedded in the bottom insole layer 219, and a location data transmitting component 226 with a transmitting antenna 217 and a transmitter 213 placed within a second housing chamber 227 embedded in the bottom insole layer 219. Also shown is a remote transmitting system 223 and remote receiving system 222.

Figure 3:
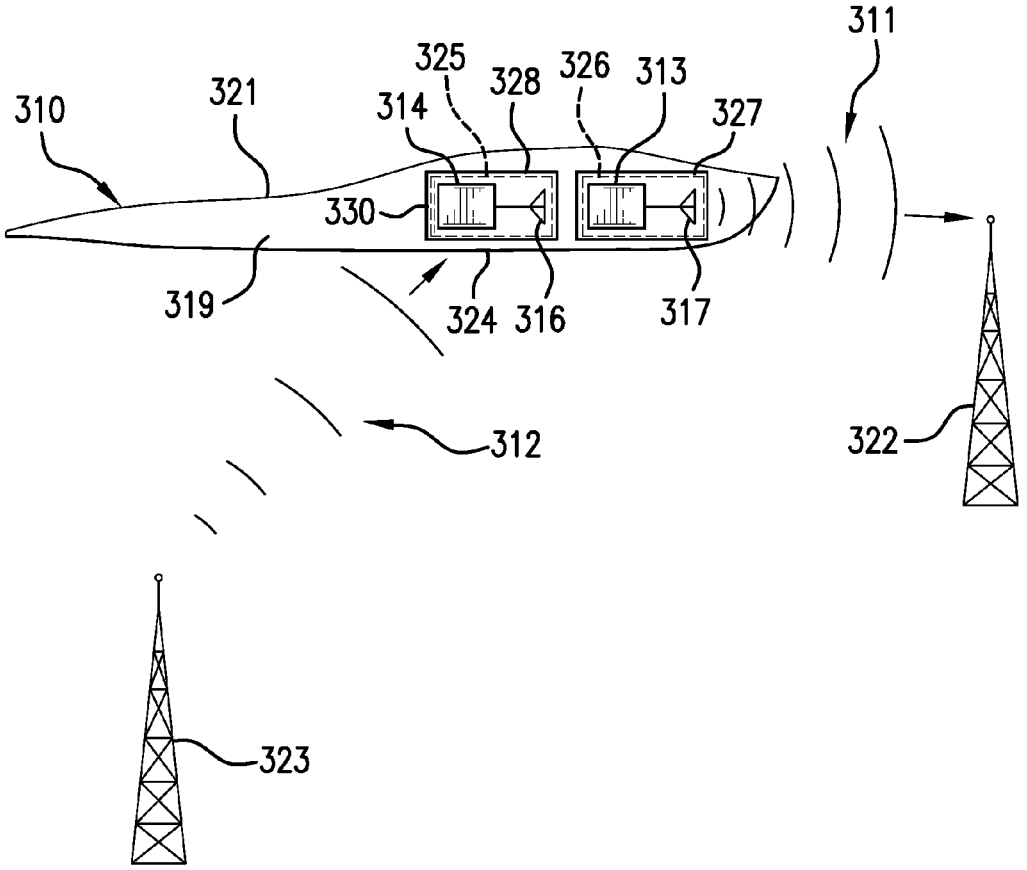
FIG. 3 is a partially cut-away side view of a unitary removable insole in use in a data transfer system.

Referring to FIG. 3, an insole 310, according to a unitary insole embodiment of the invention has a single insole layer 319 having a top side 321 and an underside 324, a location data receiving component 325 with a receiving antenna 316 and a receiver 314 placed within a first housing chamber 328 embedded in the single insole layer 319, a location data transmitting component 326 with transmitting antenna 317 and a transmitter 313 placed within a second housing chamber 327 embedded in the single insole layer 319. Also shown is a remote transmitting system 323 and remote receiving system 322.

Insole Materials

A unitary insole having a only a single layer can be made from any suitable material including, but not limited to, any flexible material which can cushion and absorb the shock from heel strike on the insole. According to the invention, the material must include a shock absorbing ability, both for protecting the electronic components and for producing a desirable insole characteristics relating to comfort and wearability.

Commonly used materials for shoe insoles are soft Plastazote, medium Pelite, PPT, Spenco, and Sorbothane. Other alternative materials which can be used include, for instance, cork, latex, natural rubber, silicone, and thermoplastic elastomeric (TPE) gel.

Considerations for the insole materials of choice include the effect on the materials of repeated compression, the effect of a combination of repetitive shear and compression, and the force-distribution (force-attenuation) properties of these materials, both when new and after repeated compression. Other factors to consider include amount and rate of permanent deformation offset by considerations of enhanced moldability. The ideal insert represents a combination of material to achieve both durability and moldability.

The material can include a shock absorbing ability, both for protecting the electronic components and for producing the desired characteristics. Suitable shock absorbing materials can include any suitable foam, such as but not limited to, cross-linked polyethylene, poly(ethylene-vinyl acetate), polyvinyl chloride, synthetic and natural latex rubbers, neoprene, block polymer elastomer of the acrylonitrile-butadiene-styrene or styrene-butadienestyrene type, thermoplastic elastomers, ethylenepropylene rubbers, silicone elastomers, polystyrene, polyurea or polyurethane; most preferably a polyurethane foam made from flexible polyol chain and an isocyanate such as a monomeric or prepolymerized diisocyanate based on 4,4'-diphenylmethane diisocyanate (MDI) or toluene diisocyanate (TDI). Such foams can be blown with freon, water, methylene chloride or other gas producing agents, as well as by mechanically frothing to prepare the shock absorbing resilient layer. Such foams advantageously can be molded into the desired shape or geometry. Non-foam elastomers such as the class of materials known as viscoelastic polymers, or silicone gels, which show high levels of damping when tested by dynamic mechanical analysis performed may also be advantageously employed. A resilient polyurethane can be prepared from diisocyanate prepolymer, polyol, catalyst and stabilizers which provide a water-blown polyurethane foam of the desired physical attributes. These urethane systems generally contain a surfactant, a blowing agent, and an ultra-violet stabilizer and/or catalyst package. A unitary layer is generally made from a urethane molded material.

Another material useful for enhancing the shock absorbing ability of the insole layers, both for protecting the electronic components and for producing other desirable insole characteristics, is a self-supporting energy absorbing composite which includes: i) a solid foamed synthetic polymer matrix; ii) a polymer-based dilatant, different from i) distributed through the matrix and incorporated therein during manufacture of i); and iii) a fluid distributed through the matrix as described in United States Published Patent Applications 2009-0324927, 2007-0029690, and 20050037189 each of which is herein incorporated by reference. A component in these compositions is a borated silicone polymer, such as polyborodimethylsiloxane (PBDMS).

Alternatively, a multilayer insole can be a laminate construction, that is, a multilayered composite of any of the above materials. Multilayered composites are made from one or more of the above materials such as a combination of polyethylene vinyl acetate and polyethylene (two layers), or a combination of ethylene propylene, polyurethane and EVA (3 layers).

In accordance with an aspect of the present invention, dual layers of a multilayer insole are made from different materials, for instance, two different polyurethane foams, having different characteristics. The layers may have the same or different thicknesses. Specifically, the bottom layer is made from a resilient foam material that provides a conventional cushioning function. In effect, bottom layer is a typical foam mechanical spring, shock absorption layer that cushions the foot, in order to decrease pressure in any area of the forefoot. On the other hand, top layer is made from a slow recovery foam material that has a conforming property. Thus, top layer temporarily collapses under pressure, and absorbs the aforementioned shear, that is, dampens the same, and accommodates the shape of the foot. If there are bony protuberances, top layer absorbs and redistributes the forces. Top layer thereby sculptures to the pressure points and spreads the pressure out along the entire forefoot portion. Thus, by using the different layers, the insole optimally accommodates the deformation of the forefoot region of the foot, and reduces foot plantar pressure.

The top insole layer can also be made from any suitable material including, but not limited to, fabrics, leather, leather board, expanded vinyl foam, flocked vinyl film, coagulated polyurethane, latex foam on scrim, supported polyurethane foam, laminated polyurethane film or in-mold coatings such as polyurethanes, styrene-butadiene-rubber, acrylonitrile-butadiene, acrylonitrile terpolymers and copolymers, vinyls, or other acrylics, as integral top covers. Desirable characteristics of top insole layer include good durability, stability and visual appearance. It is also desirable that top insole layer have good flexibility, as indicated by a low modulus, in order to be easily moldable. The bonding surface of top insole layer should provide an appropriate texture in order to achieve a suitable mechanical bond to the upper surface of lower insole layer. The top layer material can be a fabric, such as a brushed knit laminate top cloth (brushed knit fabric/urethane film/non-woven scrim cloth laminate) or a urethane knit laminate top cloth. Or it can be made from a polyester fabric material.

The materials of the unitary and multilayer insole layers can be prepared by conventional methods such as heat sealing, ultrasonic sealing, radio-frequency sealing, lamination, thermoforming, reaction injection molding, and compression molding and, if necessary, followed by secondary die-cutting or in-mold die cutting.

Other Illustrative Embodiments

Figure 4:
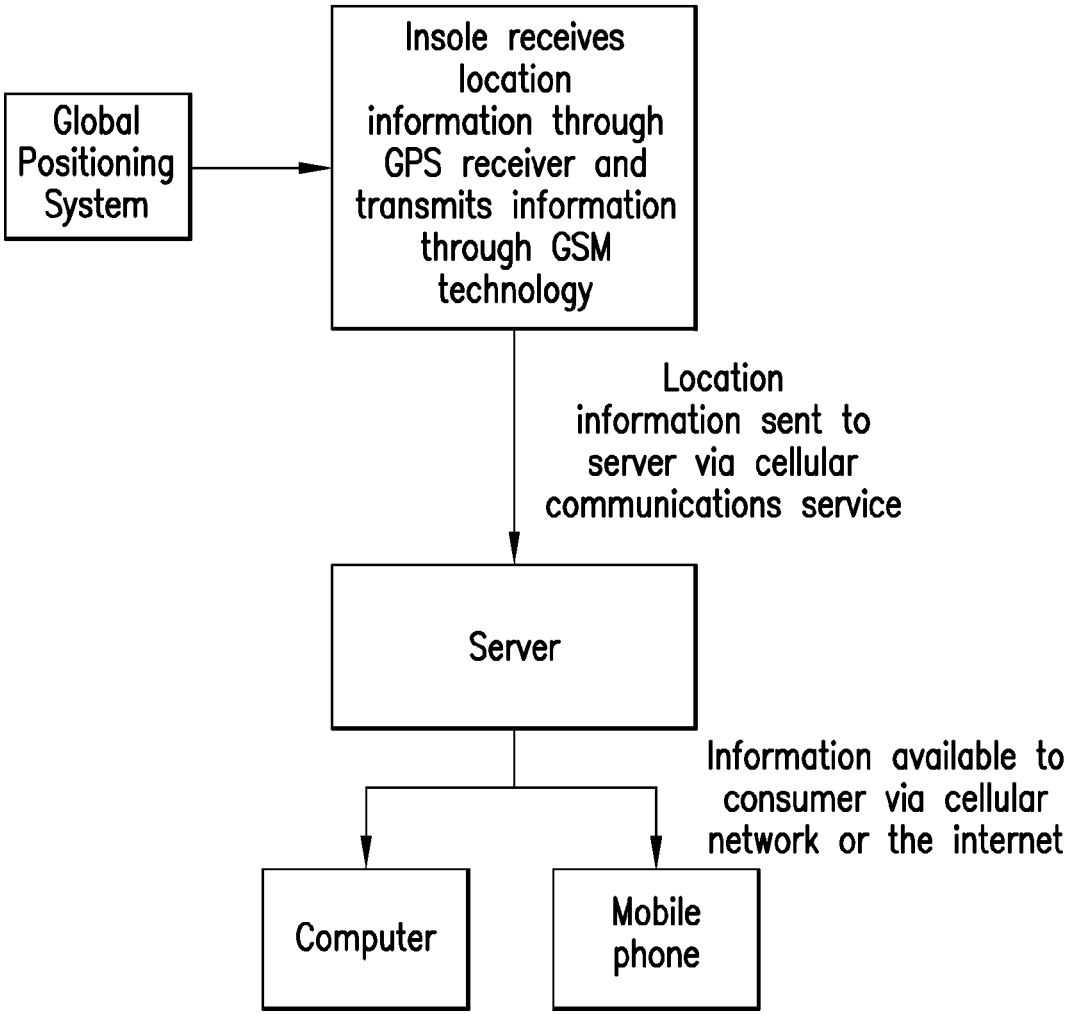
FIG. 4 is a block diagram of a data transfer system involving a removable insole having a GPS receiver and a GSM transmitter.

Referring to FIG. 4, this is a block diagram of a data transfer system involving a GPS receiver and a GSM transmitter. The GPS system is the remote transmitting system and a GSM system is the remote receiving system. The insole houses a circuitry system which contains a series of components. The components include GPS, wireless transmission modules, antennas, motion sensor, and power supply. The positioning receiver determines the position of the insole via a global positioning system, GPS, which uses satellite and terrestrial based signal transmitters. The information is stored on an attached Subscriber Identified Module, SIM card, and is transmitted to a server through a wireless telecommunications device using Global System for Mobile communications, GSM, technology where a subscriber can ultimately access the positioning information through a secure internet site on either a computer or mobile device.

Figure 5:
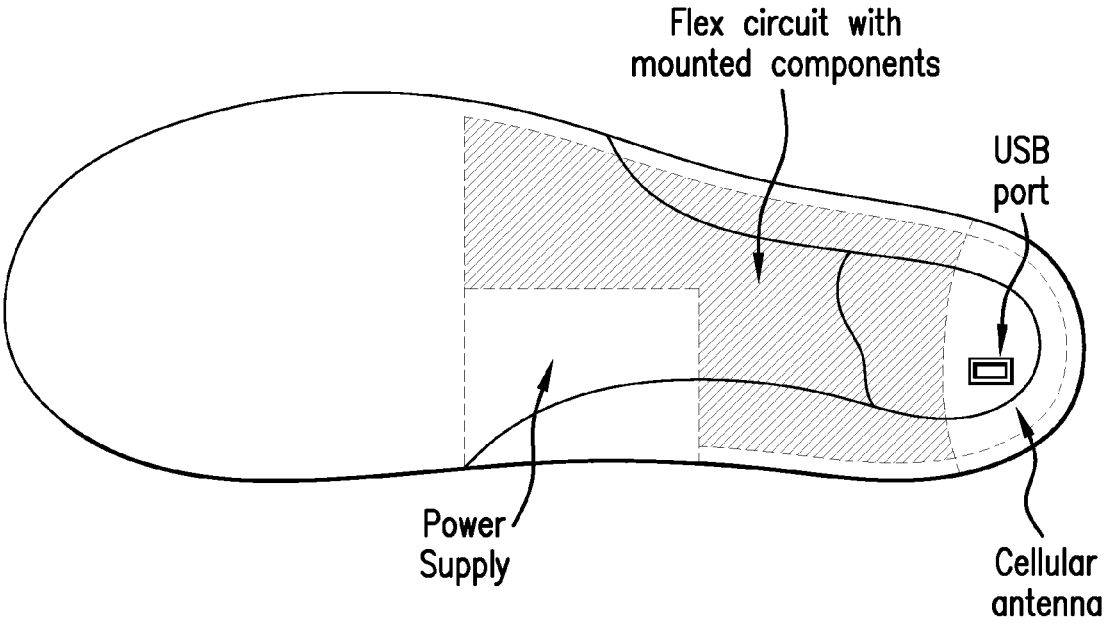
FIG. 5 is a partially cut-away top view of a removable insole involving a flexible circuitry component.

Referring to FIG. 5, this is an insole involving a flexible circuitry component. In this embodiment, the circuitry includes a GPS module, GPS antenna, GSM module, GSM antenna and USB port are positioned under the heel with the cellular antenna curving up and around the heal. The battery is placed under the arch of the foot adjacent to a motion sensor. A SIM card connector can be accessible from the bottom of the insole of side of the insole. In another embodiment, an RFID chip (not shown) is placed under the ball of the foot in the insole.

Figure 6:
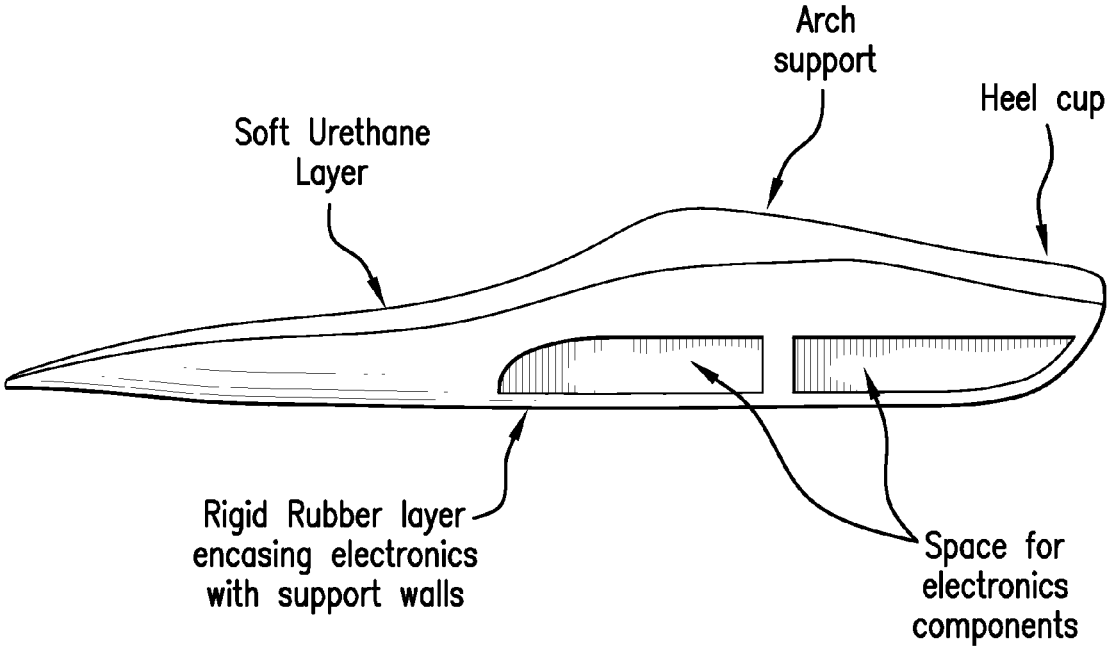
FIG. 6 is a partially cut-away side view of a multilayer removable insole.

Referring to FIG. 6, this is a multilayer insole with a rigid rubber lower insole layer and a soft polyurethane upper insole layer. The insole is constructed in laminated layers. A top layer, which is in direct contact with the foot, is constructed of an antimicrobial, moisture resistant urethane for shock absorption. The second laminate layer is constructed of a rigid rubberized material formed to the shape of the insole to add support for the wearer and protection to the electronics. The electronics are embedded within the rubber layer, and surrounded by rubber supports. The rubber will have cavity space for the battery and SIM card. The entire bottom layer is coated in a waterproofing material (not shown).

Figure 7:
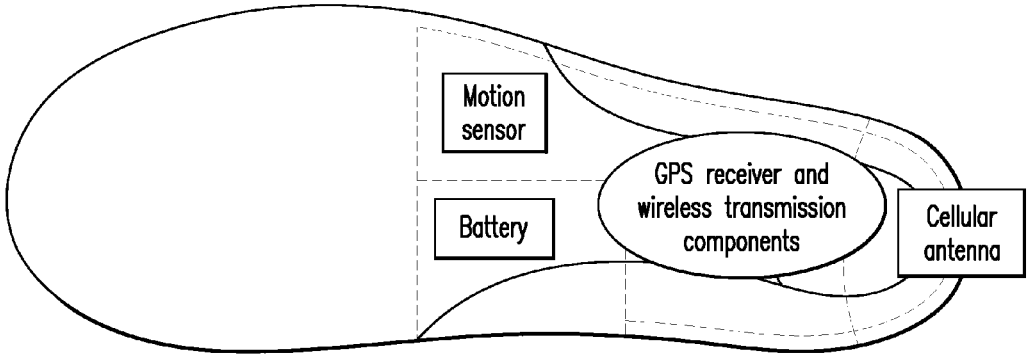
FIG. 7 is a partially cut-away top view of a removable insole involving a self-charging power source.

Referring to FIG. 7, this is an insole involving a self-charging power source. The insole is a removable shoe insert containing a small rechargeable battery, a GPS module, a GSM module, GPS and GSM antennas, flexible circuit board, SIM card chip holder, a motion sensor, and a small USB port (not shown). The circuitry is coated with a water proof material, such as polyimide resin, to protect the technology from water. The USB access (not shown) is covered with a rubberized seal to keep the port water resistant. The device is powered by a rechargeable battery, and the battery of the invention will be charged by one of two methods. The first method uses a standard USB power cable plugged into the wall. The second method would use a wireless magnetic induction system, such as a Powermat® or other wireless power source.

Figure 8:
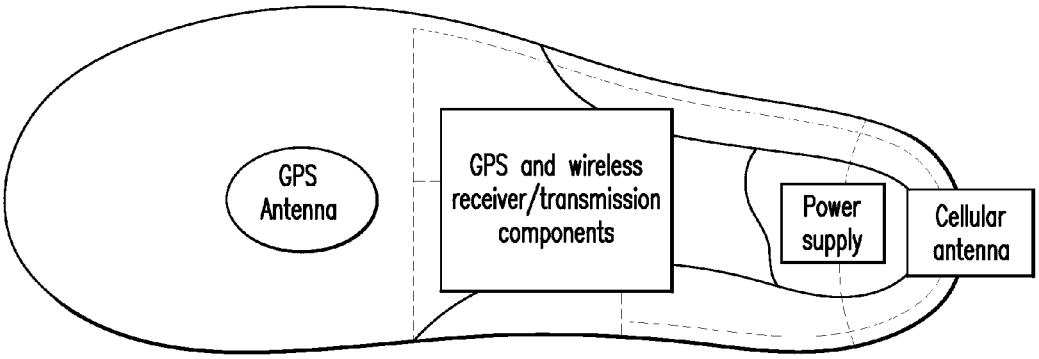
FIG. 8 is a partially cut-away top view of a removable insole involving multiple receiver/transmitter components.

Referring to FIG. 8, this is an insole involving multiple GPS and GSM receiver/transmitter components to enable the GPS system and GSM system to act concurrently as a remote transmitting system and/or a remote receiving system.

The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known manufacturing steps have not been described in detail.

Only illustrative embodiments of the present invention and but a few examples of its versatility are shown and described in the present disclosure. It is to be understood that the present invention is capable of use in various other combinations and environments and is capable of changes or modifications within the scope of the inventive concept as expressed herein. Many of the described features may be substituted, altered or omitted without departing from the scope of the invention. For example, if the wireless receiver can obtain location information from a mobile telephony network or a wireless local area network, then the GPS components can be omitted. As another example, individual wires may be substituted for a flexible circuit. As yet another example, a GPS antenna can be embedded within the insole or disposed on a surface of the insole and connected to a receiver by a flexible circuit substrate also disposed on the surface of the insole. These and other deviations from the illustrative embodiments shown will be apparent to those skilled in the art, particularly in view of the foregoing disclosure.

While the present invention has been described with respect to the illustrative embodiments, it will be apparent to those skilled in the art that various changes and modifications may be made without departing from the spirit and scope of the invention as defined in the following claims and their equivalents.

What is claimed is:

1. A multilayer insole with location tracking capability for removable placement in various articles of footwear, the multilayer insole comprising:

a top insole layer;

a bottom insole layer;

at least one intermediate layer between the top insole layer and the bottom insole layer formed from flexible material and configured to provide cushioning and/or support to a foot of a wearer within the article of footwear;

an insole location data receiver configured to receive an input signal relating to a location of the multilayer insole;

an insole location data transmitter configured to transmit an output signal relating to the location of the multilayer insole;

wherein the insole location data receiver and the insole location data transmitter are both located within the multilayer insole; and wherein movement of the multilayer insole from the article of footwear to a second article of footwear moves the insole location data transmitter and the insole location data receiver located within the multilayer insole to the second article of footwear to enable location tracking of the multilayer insole in the second article of footwear.

2. The multilayer insole of claim 1, wherein the multilayer insole comprises a material containing at least one member from the group consisting of: polyurethane, polyethylene, poly(ethylene-vinyl acetate), polyvinyl chloride, polyborodimethylsiloxane, polystyrene, acrylonitrile-butadiene-styrene, styrene-butadiene styrene, ethylenepropylene rubber, neoprene, cork, latex, natural rubber, silicone, and thermoplastic elastomeric gel.

3. The multilayer insole of claim 1, wherein at least one of the insole location data receiver or the insole location data transmitter is individually situated at least partially within the at least one intermediate layer.

4. The multilayer insole of claim 1, further comprising:

a processor; and a power source;

wherein the processor and the power source are both located within the multilayer insole.

5. The multilayer insole of claim 4, wherein at least one of the processor or the power source is individually situated at least partially within the at least one intermediate layer.

6. The multilayer insole of claim 1, wherein at least one of the insole location data receiver or the insole location data transmitter is at least partially situated within a housing chamber embedded in the at least one intermediate layer.

7. The multilayer insole of claim 1, wherein at least one of the insole location data receiver or the insole location data transmitter is at least partially situated within a continuous insole material matrix in the at least one intermediate layer.

8. The multilayer insole of claim 1, wherein at least one of the insole location data receiver or the insole location data transmitter is situated entirely between the top insole layer and the bottom insole layer.

9. The multilayer insole of claim 1, wherein at least one of the insole location data receiver or the insole location data transmitter is at least partially situated on the bottom insole layer.

10. The multilayer insole of claim 1, wherein at least one of the insole location data receiver or the insole location data transmitter is at least partially situated on the top insole layer.

11. The multilayer insole of claim 1, wherein the insole location data receiver comprises:

a receiving antenna that is either integrally associated with or independent of the insole location data transmitter; and a receiver circuit for receiving the input signal.

12. The multilayer insole of claim 1, wherein the insole location data receiver is configured to receive the input signal from either a satellite or a terrestrial transmitter.

13. The multilayer insole of claim 12, wherein the insole location data receiver is configured to receive the input signal from a Global Positioning System transmitter that is either a satellite or a terrestrial transmitter.

14. The multilayer insole of claim 1, wherein the insole location data receiver is configured to receive the input signal from a cellular network or a wireless network.

15. The multilayer insole of claim 14, wherein the cellular network is a Global System for Mobile Communications network, a Code Division Multiple Access Network or a Time Division Multiple Access network.

16. The multilayer insole of claim 15, wherein the cellular network is an analog signal capable network, a digital data signal capable network, a multimedia data signal capable network, an International Mobile Telecommunications-2000 family standard capable network or an International Mobile Telecommunications Advanced family standard signal capable network.

17. The multilayer insole of claim 1, wherein the insole location data transmitter comprises:

a transmitting antenna that is either integrally associated with or independent of the insole location data receiver; and a transmitter circuit or a transponder circuit for transmitting the output signal.

18. The multilayer insole of claim 1, wherein the insole location data transmitter comprises a Universal Serial Bus port.

19. The multilayer insole of claim 1, wherein the insole location data transmitter is configured to transmit the output signal to a satellite or a terrestrial receiver.

20. The multilayer insole of claim 1, wherein the insole location data transmitter is configured to transmit the output signal to a Global Positioning System satellite or a Global Positioning System terrestrial receiver.

21. The multilayer insole of claim 1, wherein the insole location data transmitter is configured to transmit the output signal to a cellular network, a wireless network or a radio-frequency identification tag network.

22. The multilayer insole of claim 21, wherein the cellular network is a Global System for Mobile Communications network, a Code Division Multiple Access Network or a Time Division Multiple Access network.

23. The multilayer insole of claim 21, wherein the cellular network is an analog signal capable network, a digital data signal capable network, a multimedia data signal capable network, an International Mobile Telecommunications-2000 family standard capable network or an International Mobile Telecommunications Advanced family standard signal capable network.

24. An insole with location tracking capability for removable placement in various articles of footwear, the insole comprising:

one or more insole material layers;

an insole location data receiver for receiving an input signal relating to a location of the insole;

an insole location data transmitter for transmitting an output signal relating to the location of the insole;

wherein the insole location data receiver and the insole location data transmitter are both located within the insole; and wherein movement of the insole from a first article of footwear to a second article of footwear moves the insole location data transmitter and the insole location data receiver located within the insole to the second article of footwear to enable location tracking of the insole in the second article of footwear.

25. The insole of claim 24, wherein the insole comprises a material containing at least one member from the group consisting of: polyurethane, polyethylene, poly(ethylene-vinyl acetate), polyvinyl chloride, polyborodimethylsiloxane, polystyrene, acrylonitrile-butadiene-styrene, styrene-butadienestyrene, ethylenepropylene rubber, neoprene, cork, latex, natural rubber, silicone, and thermoplastic elastomeric gel.

26. The insole of claim 24, wherein at least one of the insole location data receiver or the insole location data transmitter is at least partially situated within a housing chamber in the one or more insole material layers.

27. The insole of claim 24, further comprising:

a processor; and a power source;

wherein the processor and the power source are both located within the insole.

28. The insole of claim 27, wherein at least one of the insole location data receiver or the insole location data transmitter is at least partially situated within a continuous insole material matrix comprising the one or more insole material layers.

29. The insole of claim 24, wherein the insole location data receiver comprises:

a receiving antenna that is either integrally associated with or independent of the insole location data transmitter; and a receiver circuit for receiving the input signal.

30. The insole of claim 24, wherein the insole location data transmitter comprises:

a transmitting antenna that is either integrally associated with or independent of the insole location data receiver; and a transmitter circuit or a transponder circuit for transmitting the output signal.

31. The insole of claim 24, wherein the insole location data receiver is configured to receive the input signal from either a satellite or a terrestrial transmitter.

32. The insole of claim 24, wherein the insole location data receiver is configured to receive the input signal from a Global Positioning System transmitter that is either a satellite or a terrestrial transmitter.

33. The insole of claim 24, wherein the insole location data receiver is configured to receive the input signal from a cellular network or a wireless network.

34. The insole of claim 24, wherein the insole location data transmitter is configured to transmit the output signal to a satellite or a terrestrial receiver.

35. The insole of claim 24, wherein the insole location data transmitter is configured to transmit the output signal to a Global Positioning System satellite or a Global Positioning System terrestrial receiver.

36. The insole of claim 24, wherein the insole location data transmitter is configured to transmit the output signal to a cellular network, a wireless network or a radio-frequency identification tag network.

37. A method of manufacturing an insole with location tracking capability for removable placement in various articles of footwear, the method comprising:

forming one or more insole material layers;

incorporating an insole location data receiver for receiving an input signal relating to a location of the insole; and incorporating an insole location data transmitter for transmitting an output signal relating to the location of the insole;

wherein the insole location data receiver and the insole location data transmitter are both incorporated within the insole such that movement of the insole from a first article of footwear to a second article of footwear moves the insole location data transmitter and the insole location data receiver located within the insole to the second article of footwear to enable location tracking of the insole in the second article of footwear.

38. The method of claim 37, wherein forming the one or more insole material layers comprises incorporating a material containing at least one member from the group consisting of: polyurethane, polyethylene, poly(ethylene-vinyl acetate), polyvinyl chloride, polyborodimethylsiloxane, polystyrene, acrylonitrile-butadiene-styrene, styrene-butadienestyrene, ethylenepropylene rubber, neoprene, cork, latex, natural rubber, silicone, and thermoplastic elastomeric gel.

39. The method of manufacturing a insole according to claim 37, further comprising:

incorporating a processor; and incorporating a power source;

wherein the processor and the power source are both incorporated within the insole.

40. A method of manufacturing a multilayer insole with location tracking capability for removable placement in various articles of footwear, the method comprising:

forming a top insole layer;

forming a bottom insole layer;

incorporating an insole location data receiver for receiving an input signal relating to a location of the multilayer insole; and incorporating an insole location data transmitter for transmitting an output signal relating to the location of the multilayer insole;

wherein the insole location data receiver and the insole location data transmitter are both incorporated within the multilayer insole such that movement of the multilayer insole from a first article of footwear to a second article of footwear moves the insole location data transmitter and the insole location data receiver incorporated within the multilayer insole to the second article of footwear to enable location tracking of the multilayer insole in the second article of footwear.

41. The method of claim 40, further comprising incorporating into the insole a material containing at least one member from the group consisting of: polyurethane, polyethylene, poly(ethylene-vinyl acetate), polyvinyl chloride, polyborodimethylsiloxane, polystyrene, acrylonitrile-butadiene-styrene, styrene-butadienestyrene, ethylenepropylene rubber, neoprene, cork, latex, natural rubber, silicone, and thermoplastic elastomeric gel.

42. The method of claim 40, further comprising:

incorporating a processor; and incorporating a power source;

wherein the processor and the power source are both incorporated within the insole.

* * * * *